US010477907B2

(12) United States Patent
Oh et al.

(10) Patent No.: US 10,477,907 B2
(45) Date of Patent: Nov. 19, 2019

(54) SKIN CARE MASK GLOVE AND MASK SOCK

(71) Applicant: Voesh Corporation, Plainview, NY (US)

(72) Inventors: Seunghee Oh, Roslyn Heights, NY (US); You Seok Park, Gyeonggi-do (KR)

(73) Assignee: VOESH CORPORATION, Plainview, NY (US)

( * ) Notice: Subject to any disclaimer, the term of this patent is extended or adjusted under 35 U.S.C. 154(b) by 451 days.

(21) Appl. No.: 15/210,416

(22) Filed: Jul. 14, 2016

(65) Prior Publication Data

US 2016/0316834 A1 Nov. 3, 2016

Related U.S. Application Data

(62) Division of application No. 13/913,756, filed on Jun. 10, 2013, now Pat. No. 10,231,497.

(51) Int. Cl.

| | |
|---|---|
| ***A41D 19/00*** | (2006.01) |
| ***A41D 11/00*** | (2006.01) |
| ***A41B 11/00*** | (2006.01) |

(52) U.S. Cl.

CPC ..... *A41D 19/0048* (2013.01); *A41B 11/00* (2013.01); *A41D 19/0006* (2013.01); *A41D 19/0013* (2013.01); *A41B 2400/32* (2013.01); *A41D 2400/32* (2013.01)

(58) Field of Classification Search

CPC ..... A41D 19/0013; A41D 19/0048; A41D 19/0006; A41D 2400/32; D04B 1/24; D04B 1/26; D04B 1/265; A41B 11/00; A41B 11/005; A41B 11/06; A41B 2400/32

See application file for complete search history.

(56) References Cited

U.S. PATENT DOCUMENTS

| | | | | | |
|---|---|---|---|---|---|
| 3,417,408 | A * | 12/1968 | Caggiano | A43B 3/24 | 2/239 |
| 4,021,941 | A * | 5/1977 | Caggiano | A01M 29/34 | 36/10 |
| 4,709,419 | A * | 12/1987 | Heyn | A41D 13/1236 | 2/247 |
| 5,937,542 | A * | 8/1999 | Bourdeau | A43B 5/0405 | 36/10 |
| 2006/0130216 | A1 * | 6/2006 | Allsebrook | A41B 11/00 | 2/239 |

(Continued)

*Primary Examiner* — Jameson D Collier
*Assistant Examiner* — Jocelyn Bravo
(74) *Attorney, Agent, or Firm* — Tutunjian & Bitetto, P.C.

(57) ABSTRACT

A skin care mask glove is disclosed. The skin care mask glove comprises a glove portion. The glove portion includes an opening section, a hand section, a thumb section and a set of finger sections. The opening section includes an opening configured for receiving a hand and a tightening strap for tightening the opening section after a hand is inserted. The thumb section includes a first perforated line and a removable thumb end-portion. Each of the finger sections includes a second perforated line and a removable finger end-portion. The removable finger end-portions are connected via connector fabric. The glove portion is constructed having, among other things, a first outer layer, a first inner layer and a layer of a first skin care product.

6 Claims, 10 Drawing Sheets

(56) References Cited

U.S. PATENT DOCUMENTS

| | | | | |
|---|---|---|---|---|
| 2007/0124847 | A1* | 6/2007 | Yoon | A41D 19/0068 2/159 |
| 2007/0227045 | A1* | 10/2007 | Aveni | A43B 3/24 36/54 |
| 2008/0060118 | A1* | 3/2008 | Stuart | A41B 11/00 2/240 |
| 2009/0293173 | A1* | 12/2009 | Gudzak | A41B 11/002 2/160 |

* cited by examiner

200

300

SKIN CARE MASK GLOVE AND MASK SOCK

TECHNICAL FIELD

The present disclosure is related to skin care mask gloves and mask socks.

BACKGROUND

Skin care mask gloves and socks have become popular tools for providing skin care to hands and feet for women as well as men. The inside of such gloves and socks are filled with nourishing essence or cream to help hydrate and nourish the skin. In order to hydrate and nourish the skin properly, however, the mask gloves and/or socks must be worn for a long duration, and a person wearing the gloves/socks is not able to perform, or participate in, other useful activities for the duration. While wearing the gloves and/or socks, a person must also ensure that the gloves and/or socks are properly tightened to prevent the moistures and nourishments from escaping.

SUMMARY

In accordance with the disclosed subject matter, skin care mask gloves and socks are provided. Specifically, the disclosed skin care mask gloves and socks enable and facilitate manicure, pedicure and/or other cosmetic services as well as some therapeutic treatments while providing desired skin care to the hands and feet.

The disclosed subject matter includes a skin care mask glove comprising a glove portion. The glove portion includes an opening section having an opening configured for receiving a hand and a tightening strap for tightening the opening section after a hand is inserted. The glove portion also includes a hand section, a thumb section and a set of finger sections. The thumb section includes a first perforated line and a removable thumb end-portion. Each of the finger sections has a second perforated line and a removable finger end-portion. The removable finger end-portions may be connected via connector fabric. The glove portion is constructed having, among other things, an outer layer, an inner layer and a layer of a skin care product.

The disclosed subject matter also includes a skin care mask sock comprising a sock portion and a leg extension portion. The sock portion includes a first opening section having a first opening configured for receiving a foot and a first tightening strap for tightening the first opening section after a foot is inserted. The sock portion also includes a foot section and a toe section having a first perforated line and a removable end-portion. The sock portion is constructed having, among other things, a first outer layer, a first inner layer and a layer of a first skin care product.

The leg extension portion includes a second opening section having a second opening configured for receiving a foot and a second tightening strap for tightening the second opening section after a foot is inserted. The leg extension portion also includes a leg section and an ankle section that is coupled to the first opening section and that has a third opening and a third tightening strap for tightening the ankle section after a foot is inserted. The first opening section is coupled to the ankle section via a middle section having a second perforated line. The leg extension portion is made of, among other things, a second outer layer, a second inner layer and a layer of a second skin care product.

The disclosed subject matter further includes a skin care mask glove comprising a glove portion and an arm extension portion. The glove portion includes a first opening section having a first opening configured for receiving a hand and a first tightening strap for tightening the first opening section after a hand is inserted. The glove portion also includes a hand section, a thumb section and a set of finger sections. The thumb section includes a first perforated line and a removable thumb end-portion. Each of the finger sections has a second perforated line and a removable finger end-portion. The removable finger end-portions are connected via connector fabric. The glove portion is made of, among other things, a first outer layer, a first inner layer and a layer of a first skin care product. The first inner layer is an absorbent carrying the first skin care product.

The arm extension portion includes a second opening section having a second opening configured for receiving a hand and a second tightening strap for tightening the second opening section after a hand is inserted. The arm extension portion also includes an arm section and a wrist section that is coupled to the first opening section and that has a third tightening strap for tightening the wrist section after a hand is inserted. The arm extension portion is constructed having, among other things, a second outer layer, a second inner layer and a layer of a second skin care product. The second inner layer is an absorbent carrying the second skin care product. The glove portion and the arm extension portion are coupled via a middle section having a third perforated line configured to facilitate separation of the hand portion from the arm extension portion. The glove portion, the arm extension portion and the middle section form a unified structure.

There has thus been outlined, rather broadly, the features of the disclosed subject matter in order that the detailed description thereof that follows may be better understood, and in order that the present contribution to the art may be better appreciated. There are, of course, additional features of the disclosed subject matter that will be described hereinafter and which will form the subject matter of the claims appended hereto.

In this respect, before explaining at least one embodiment of the disclosed subject matter in detail, it is to be understood that the disclosed subject matter is not limited in its application to the details of construction and to the arrangements of the components set forth in the following description or illustrated in the drawings. The disclosed subject matter is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures for carrying out the several purposes of the disclosed subject matter. It is important, therefore, that the claims be regarded as including such equivalent constructions insofar as they do not depart from the spirit and scope of the disclosed subject matter.

These together with the other objects of the disclosed subject matter, along with the various features of novelty which characterize the disclosed subject matter, are pointed out with particularity in the claims annexed to and forming a part of this disclosure. For a better understanding of the disclosed subject matter, its operating advantages and the specific objects attained by its uses, reference should be had to the accompanying drawings and descriptive matter in which there are illustrated preferred embodiments of the disclosed subject matter.

BRIEF DESCRIPTION OF THE DRAWINGS

Various objects, features, and advantages of the disclosed subject matter can be more fully appreciated with reference to the following detailed description of the disclosed subject matter when considered in connection with the following drawings, in which like reference numerals identify like elements.

DETAILED DESCRIPTION

In the following description, numerous specific details are set forth regarding the disclosed subject matter and the environment in which the subject matter is used, in order to provide a thorough understanding of the disclosed subject matter. It will be apparent to one skilled in the art, however, that the disclosed subject matter may be practiced without such specific details, and that certain features, which are well known in the art, are not described in detail in order to avoid complication of the disclosed subject matter.

Figures 1A, 1B:
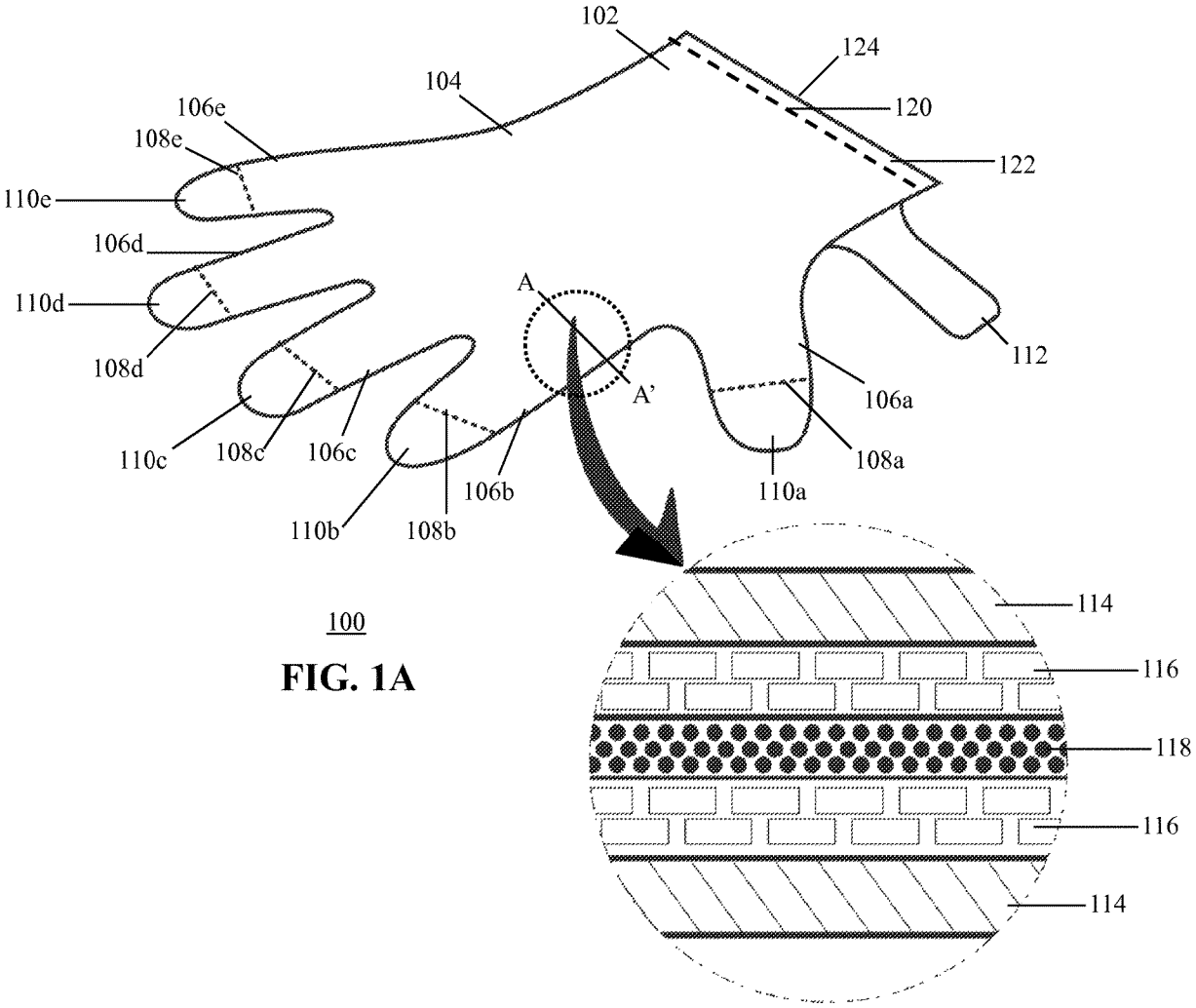
FIG. 1A is a top plan view of a skin care hand mask glove in accordance with an embodiment of the disclosed subject matter.
FIG. 1B is a cross sectional view taken at line A-A' of FIG. 1A in accordance with an embodiment of the disclosed subject matter.

FIG. 1A is a top plan view of a skin care hand mask glove 100 in accordance with an embodiment of the disclosed subject matter. Glove 100 includes an opening section 102 having a tightening strap 112, a hand section 104, a thumb section 106*a* having a perforated line 108*a* and removable thumb tip 110*a* (also referred to as "removable thumb end-portion") and a set of finger sections 106*b-e* having corresponding perforated lines 108*b-e* and removable finger tips (also referred to as "removable end-portions") 110*b-e*. Thumb section 106*a* and each finger section 106*b-e* has a perforated line 108 such that the corresponding removable thumb tip 110*a* or finger tip 110*b-e* can be readily separated from glove 100 when a user tears off the thumb/finger tip along the corresponding perforated line 108. In one embodiment, tightening strap (also referred to as a sealing strap) 112 is a separate piece of fabric that is attached to opening section 102. In one embodiment, tightening strap 112 has a section including hook type fastener and opening section 102 has a section including loop type fastener that can receive the hook type fastener.

Opening section 102 may also include a perforated line 120 and a removable end-portion 122 that a user can separate from glove 100 to unseal the glove. In one embodiment, a zipper clip is provided near perforated line 120 such that a user can seal glove 100 again after she opens the glove by tearing off removable end-portion 122.

As shown in FIG. 1B, glove 100 is constructed having an outer layer 114, an inner layer 116 and a layer of skin care product 118. Skin care product 118 includes gel, paste or other fluidic material with cosmetic or medicinal/therapeutic effect. For example, skin care product 118 may be any appropriate skin care material, including various essence creams, moisturizers or any combination thereof. In one embodiment, outer layer 114 is made of plastic or other similar materials, such as synthetic resins, and inner layer 116 is made of non-woven fabric. In one embodiment, inner layer 116 is an absorbent carrying skin care product 118.

In one embodiment, the peripheral edges of outer layer 114 and the peripheral edges of inner layer 116 are bonded. In another embodiment, outer layer 114 and inner layer 116 are bonded only at the edges of the opening portion 124. Outer layer 114 and inner layer 116 can be bonded using any appropriate bonding technique that is known in the art, such as an adhesive.

Figure 2:
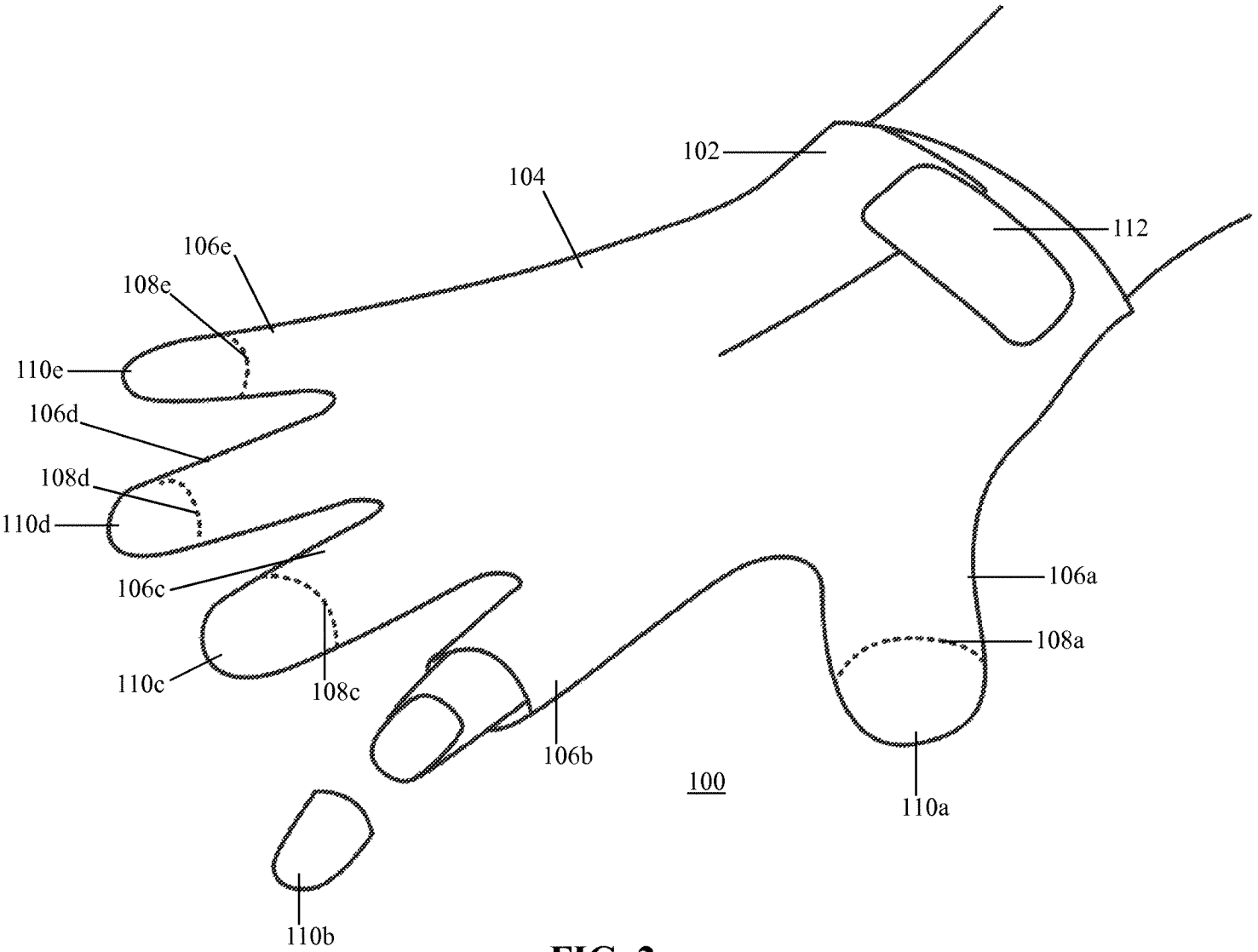
FIG. 2 is a top plan view of a skin care hand mask glove in use in accordance with an embodiment of the disclosed subject matter.

FIG. 2 is a top plan view of glove 100 in use in accordance with an embodiment of the disclosed subject matter. Removable finger tip 110*b* (the tip of the index finger section) is torn off along perforated line 108*b* and removed so that a person wearing glove 100 may use her index finger while still wearing glove 100. With thumb tip 110*a* and finger tips 110*b-e* removed one at a time, for example, the wearer can have a manicure service, thereby saving the user's time to receive both skin care and manicure services at the same time. Tightening strap 112 is used to tighten opening section 102. In one embodiment, tightening strap 112 includes a type of adhesive-backed tape to hold tightening strap 112 around opening section 102.

Figure 3:
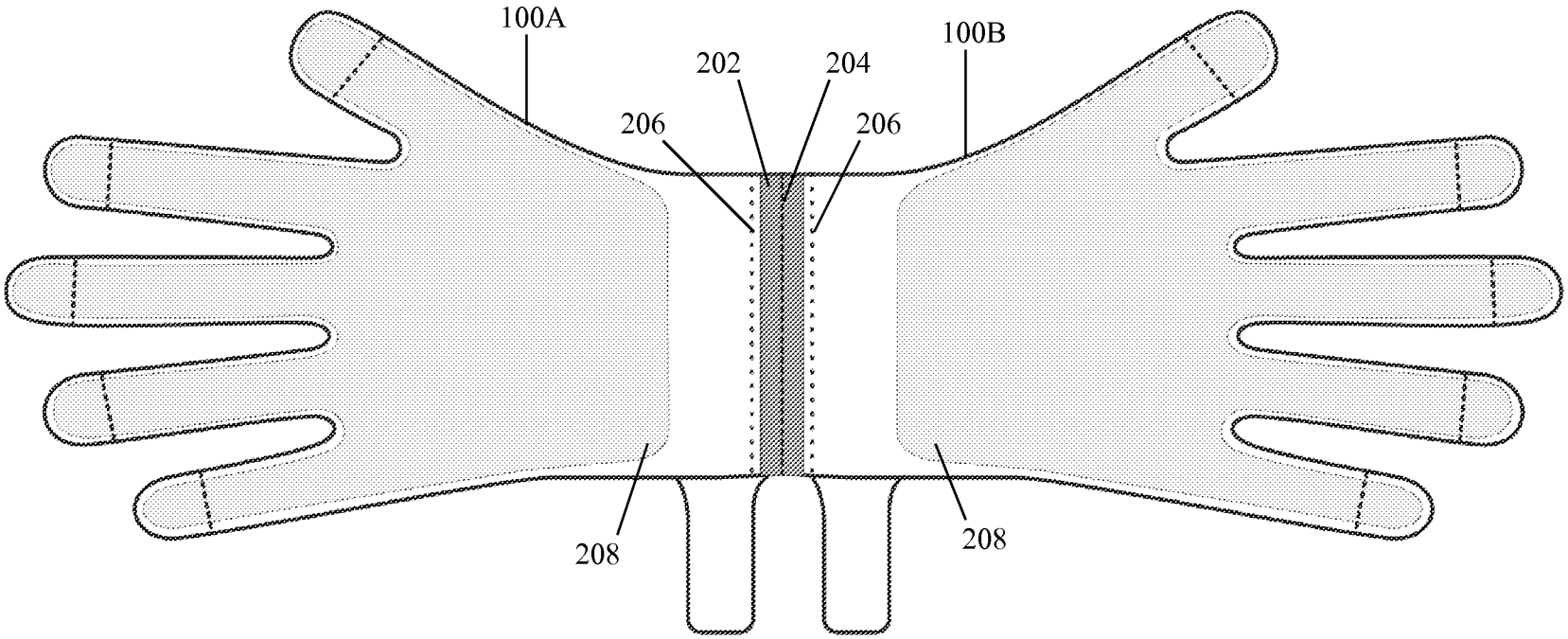
FIG. 3 is a top plan view of a pair of skin care hand mask gloves in accordance with an embodiment of the disclosed subject matter.

FIG. 3 is a top plan view of a pair of skin care hand mask gloves 200 in accordance with an embodiment of the disclosed subject matter. Pair of gloves 200 includes a right hand skin care mask glove 100A, a left hand skin care mask glove 100B, a middle section 202, a perforated line (also referred to as "detaching line") 204 and spot hot stamp lines 206. Each glove 100A, 100B includes inner layer 116 that is used as an absorbent 208 carrying a skin care product, such as skin care product 118. In this embodiment, a pair of gloves 200 is manufactured as a unified structure for ease of packaging and handling. Gloves 100A and 100B are readily separated by a user by tearing along perforated line 204.

Middle section 202 is an area that connects gloves 100A and 100B, thereby forming a unified structure and preventing the skin care product and moisture from escaping. Perforated line 204 facilitates separation of gloves 100A and 100B for use. Spot hot stamp lines 206 can help a user locate and open opening portion 124 of gloves 100A, 100B after separating the gloves pair.

Figure 4:
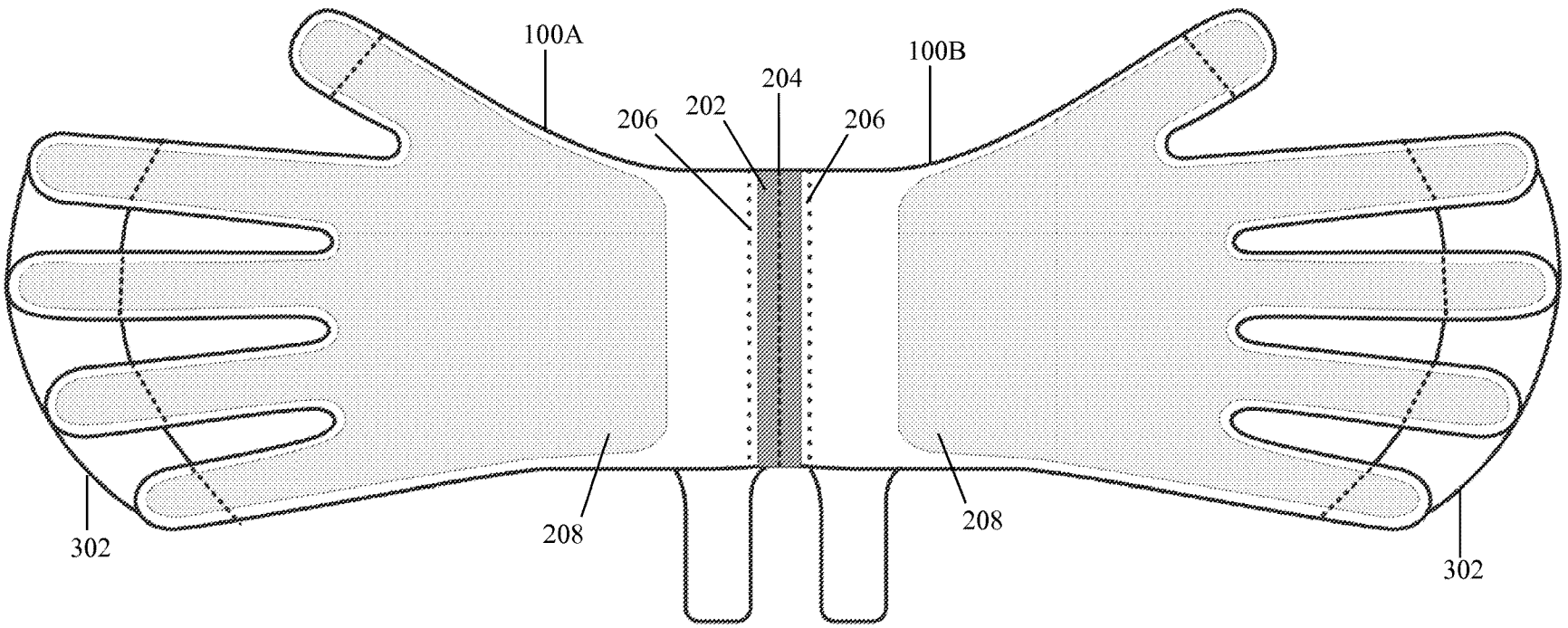
FIG. 4 is a top plan view of a pair of skin care hand mask gloves having connector fabric in accordance with an embodiment of the disclosed subject matter.

FIG. 4 is a top plan view of a pair of skin care hand mask gloves 300 having connector fabric 302 in accordance with an embodiment of the disclosed subject matter. Gloves pair 300 includes gloves 100A and 100B, middle section 202, perforated line 204 and spot hot stamp lines 206. In addition, gloves pair 300 includes connector fabric 302 that connects removable finger tips, such as removable finger tips 110*b-e*. Connector fabric 302 helps a user tear off the connected finger tips at once, thereby saving the user's time.

Figure 5A:
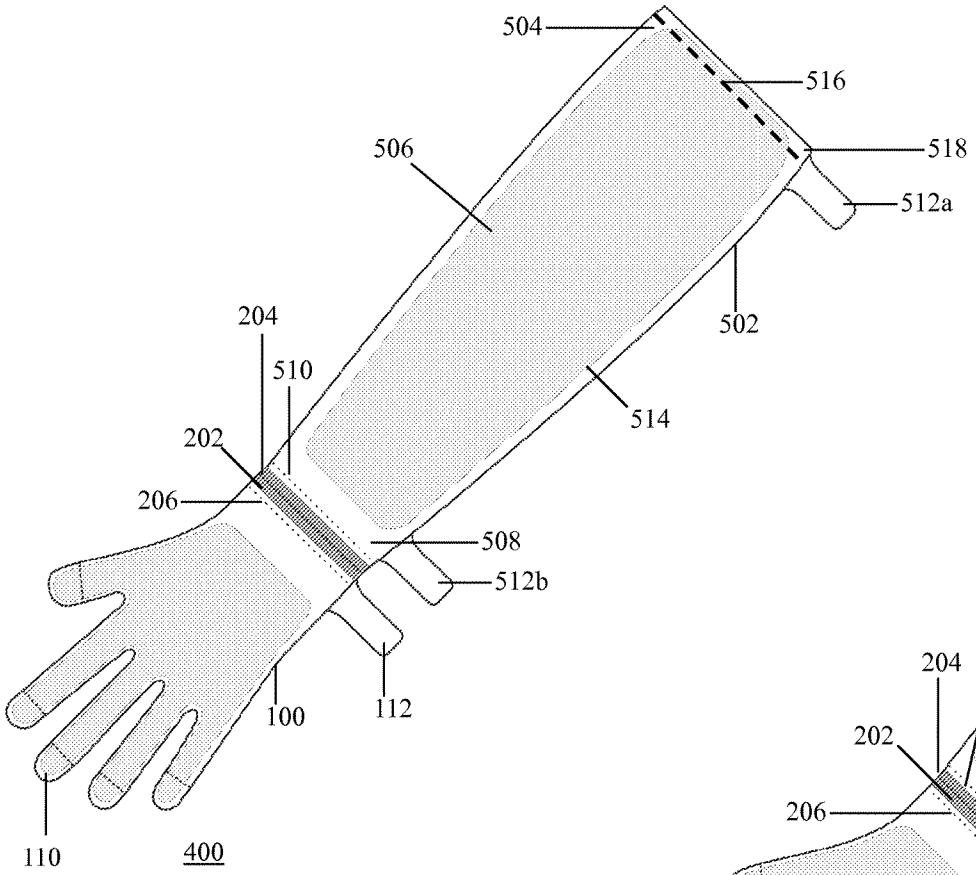
FIGS. 5A-B are top plan views of a skin care mask glove having an arm extension mask in accordance with an embodiment of the disclosed subject matter.

In FIG. 5A, a skin care mask glove 400 comprises glove portion 100 and an arm extension 502. Glove portion 100 and arm extension 502 are connected at middle section 202 and can be readily separated by tearing along perforated line 204. As discussed with reference to FIGS. 1-3, glove portion 100 includes, among other things, removable thumb and finger tips 110, tightening strap 112 and spot hot stamp line 206.

Arm extension 502 includes an opening section 504 having a tightening strap 512*a*, an arm section 506, a wrist section 508 having a spot hot stamp line 510 and a tightening strap 512*b*. In one embodiment, arm extension 502 is constructed having an outer layer, such as outer layer 114 (shown in FIG. 1), inner layer 514 and a layer of skin care product, such as skin care product 118 (also shown in FIG. 1). Opening section 504 may also include a perforated line 516 and a removable end-portion 518 that can be torn off to unseal glove 400 for use.

Figure 5B:
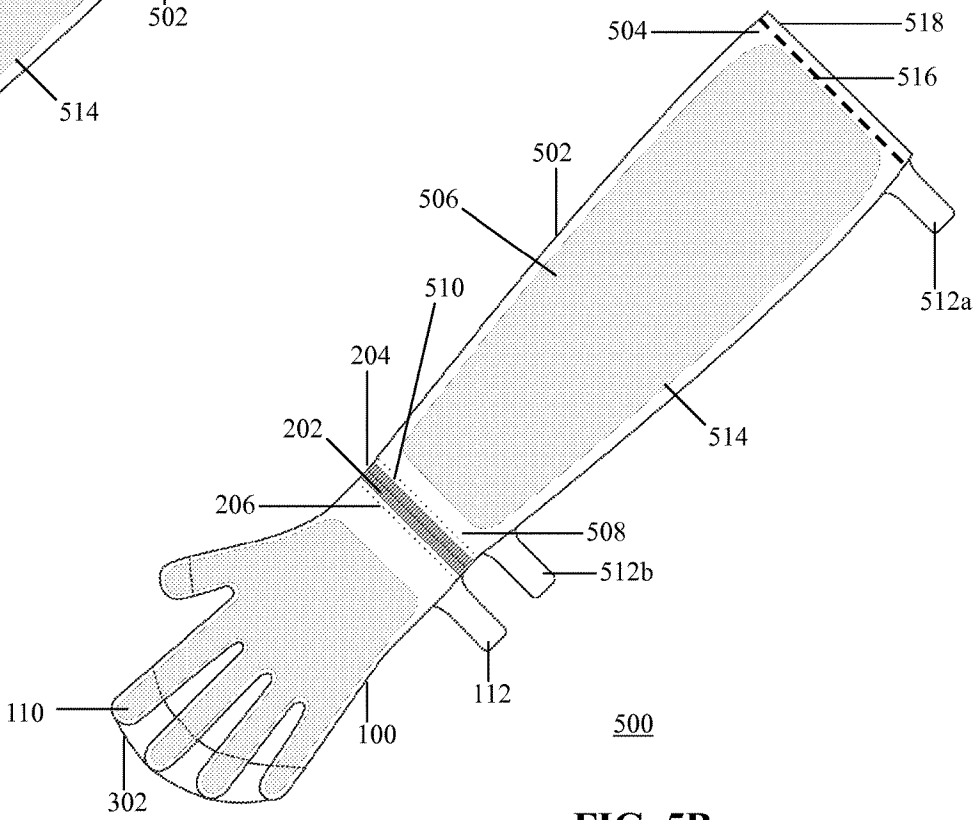

FIG. 5B is a top plan view of a skin care mask glove 500, which is identical to glove 400 shown in FIG. 5A in composition but includes connector fabric 302 connecting removable finger tips, such as removable finger tips 110*b-e*.

Figure 6:
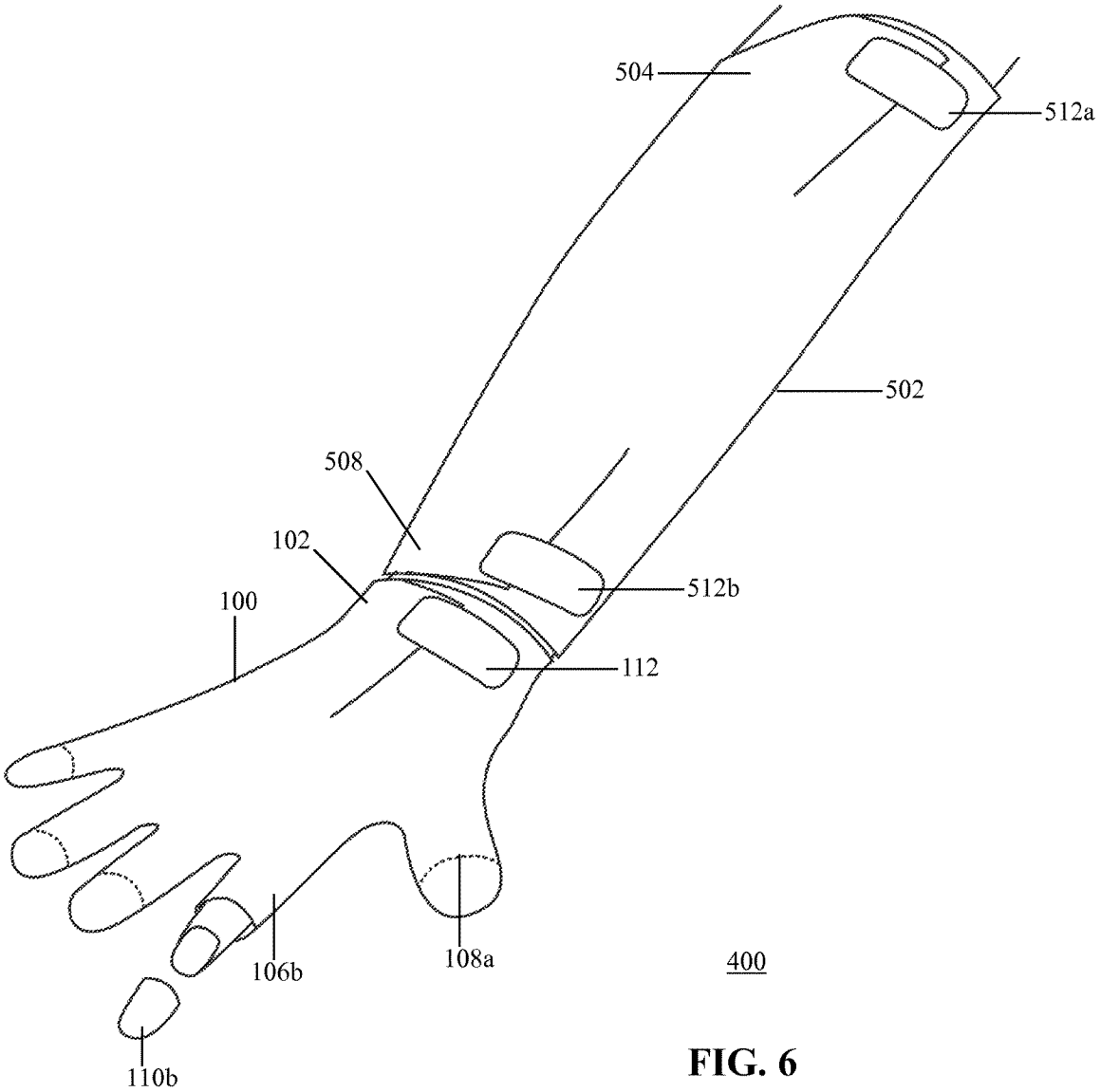
FIG. 6 is an elevated view of a skin care mask glove in use in accordance with an embodiment of the disclosed subject matter.

FIG. 6 is an elevated view of glove 400 in use in accordance with an embodiment of the disclosed subject matter. A removable finger tip (removable finger tip 110*b*) of a finger section (106*b*) is torn off along the corresponding perforated line (perforated line 108*b*) and separated from glove 400 so that a user wearing hand portion 100 of glove 400 may use her index finger while still wearing hand portion 100. For example, the user may use the exposed index finger to perform a task involving an electronic device having a touch-screen display. Tightening strap 112 is used to tighten opening section 102 and tightening straps 512*a-b* are used to tighten opening section 504 and wrist section 508. The user may also separate arm extension 502 from hand portion 100 along perforated line 204 (shown in FIGS. 5A-B) either before or after wearing glove 400.

Figure 7:
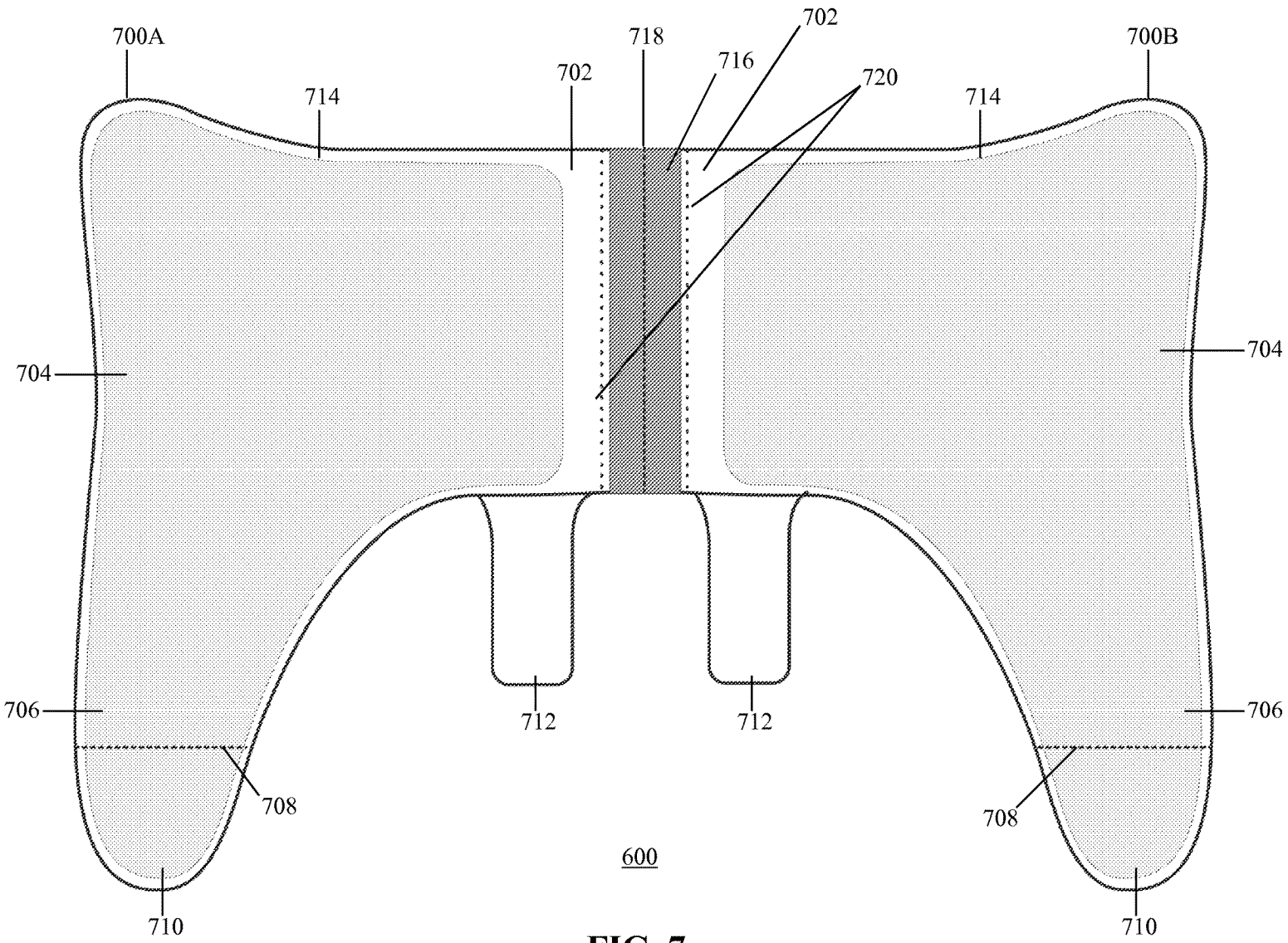
FIG. 7 is a top plan view of a pair of skin care foot mask socks in accordance with an embodiment of the disclosed subject matter.

FIG. 7 is a top plan view of a pair of socks 600 in accordance with an embodiment of the disclosed subject matter. Socks pair 600 includes a right foot sock 700A, a left foot sock 700B, a middle section 716 and a perforated line 718. Each sock 700A, 700B includes an opening section 702, a foot section 704 and a toe section 706. Opening section 702 includes spot hot stamp line 720 and a tightening strap 712. Toe section 706 includes a perforated line 708 and a removable toe tip 710 such that removable toe tip 710 can be readily separated from foot mask sock 700A, 700B when a user tears off toe tip 710 along perforated line 708.

Each sock 700A, 700B is constructed having, among other things, an outer layer, such as outer layer 114 (shown in FIG. 1), an inner layer 714 and a layer of skin care product, such as skin care product 118 (also shown in FIG. 1). Middle section 716 is an area that connects socks 700A and 700B, thereby forming a unified structure and preventing the skin care product and moisture from escaping. Perforated line 718 facilitates separation of socks 700A and 700B for use. Spot hot stamp lines 720 can help a user open the opening in opening section 702 after separating the foot socks pair.

Figure 8B:
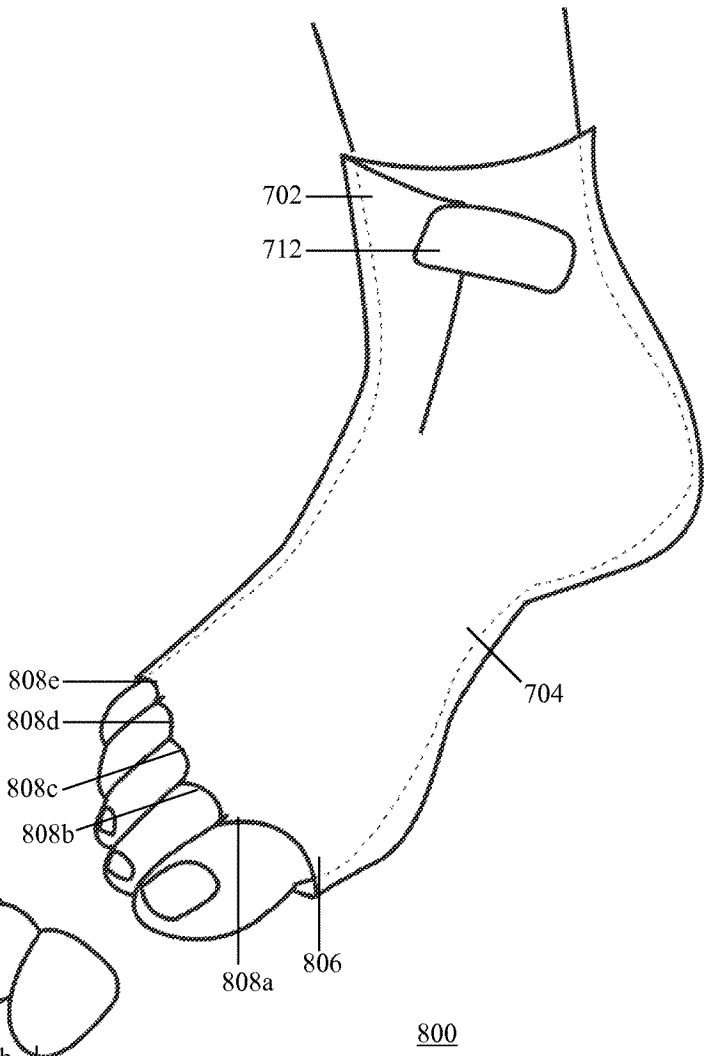
FIGS. 8A-B are elevated views of a skin care foot mask sock in use in accordance with an embodiment of the disclosed subject matter.
Figure 8A:
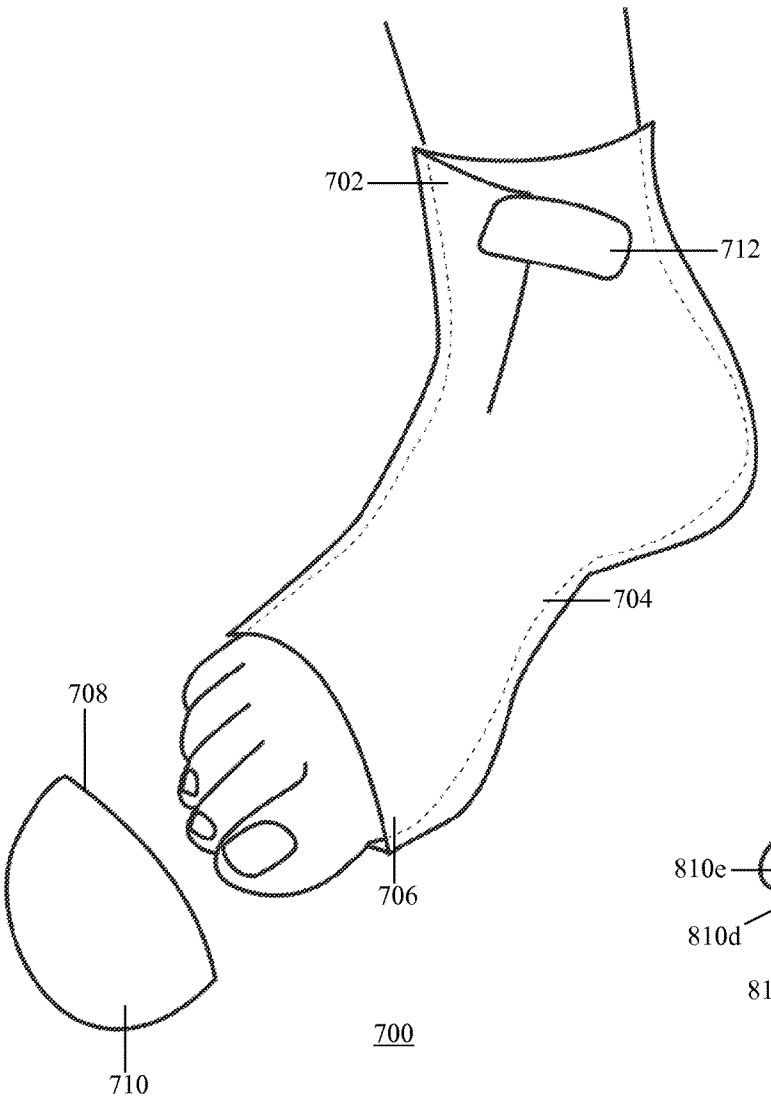

FIGS. 8A-B are top elevated views of socks 700 and 800 in use in accordance with an embodiment of the disclosed subject matter. Referring to FIG. 8A, removable toe tip 710 of toe section 706 is torn off along perforated line 708 and separated from sock 700 so that the wearer can expose her toes for useful services, such as pedicure service or other toe treatments (e.g., toe massage, athlete's foot treatment). Tightening strap 712 is used to tighten opening section 702.

Referring to FIG. 8B, sock 800 includes, among others, a toe section 806 having a set of removable toe tips 810*a-e* and corresponding perforated lines 808*a-e*. Each removable toe tip 810 can be readily separated from sock 800 by a user when the user tears it off along the corresponding perforated line 808.

Figure 9:
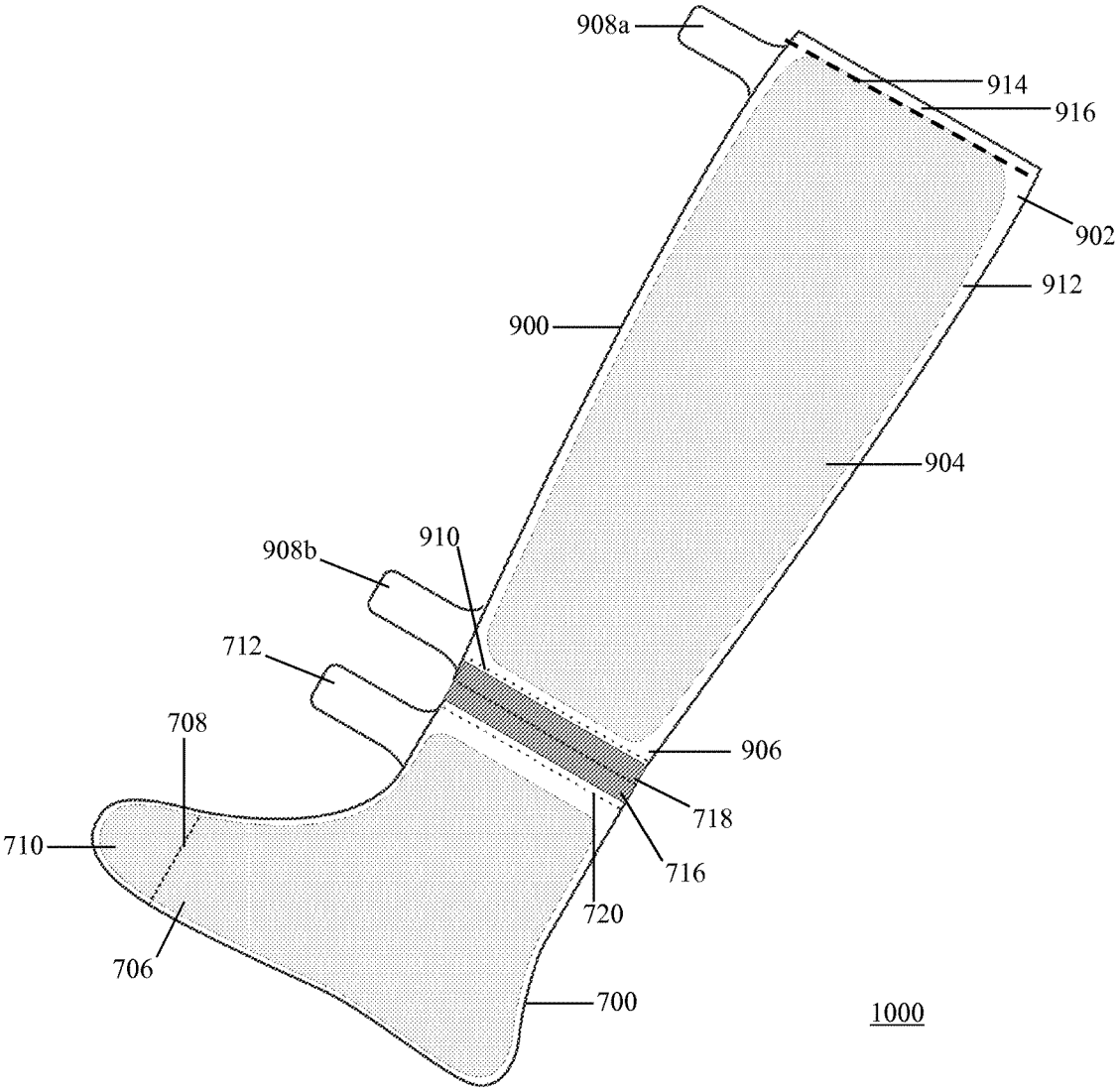
FIG. 9 is a top plan view of a skin care mask sock in accordance with an embodiment of the disclosed subject matter.

FIG. 9 is a top plan view of a skin care mask sock 1000 in accordance with an embodiment of the disclosed subject matter. Sock 1000 includes sock portion 700, a leg extension 900, a middle section 716 and a perforated line 718. Sock portion 700 includes, among other things, toe section 706 having removable toe tip 710 and perforated line 708, tightening strap 712 and spot hot stamp line 720.

Leg extension 900 includes an opening section 902 having a tightening strap 908*a*, a leg section 904 and an ankle section 906 having a tightening strap 908*b* and a spot hot stamp line 910. Leg extension 900 is constructed having, among other things, an outer layer, such as outer layer 114 (shown in FIG. 1), an inner layer 912 and a layer of skin care product, such as skin care product 118 (also shown in FIG. 1). Opening section 902 may also include a perforated line 914 and a removable end-portion 916 that can be torn off to unseal sock 1000 for use.

Figure 10:
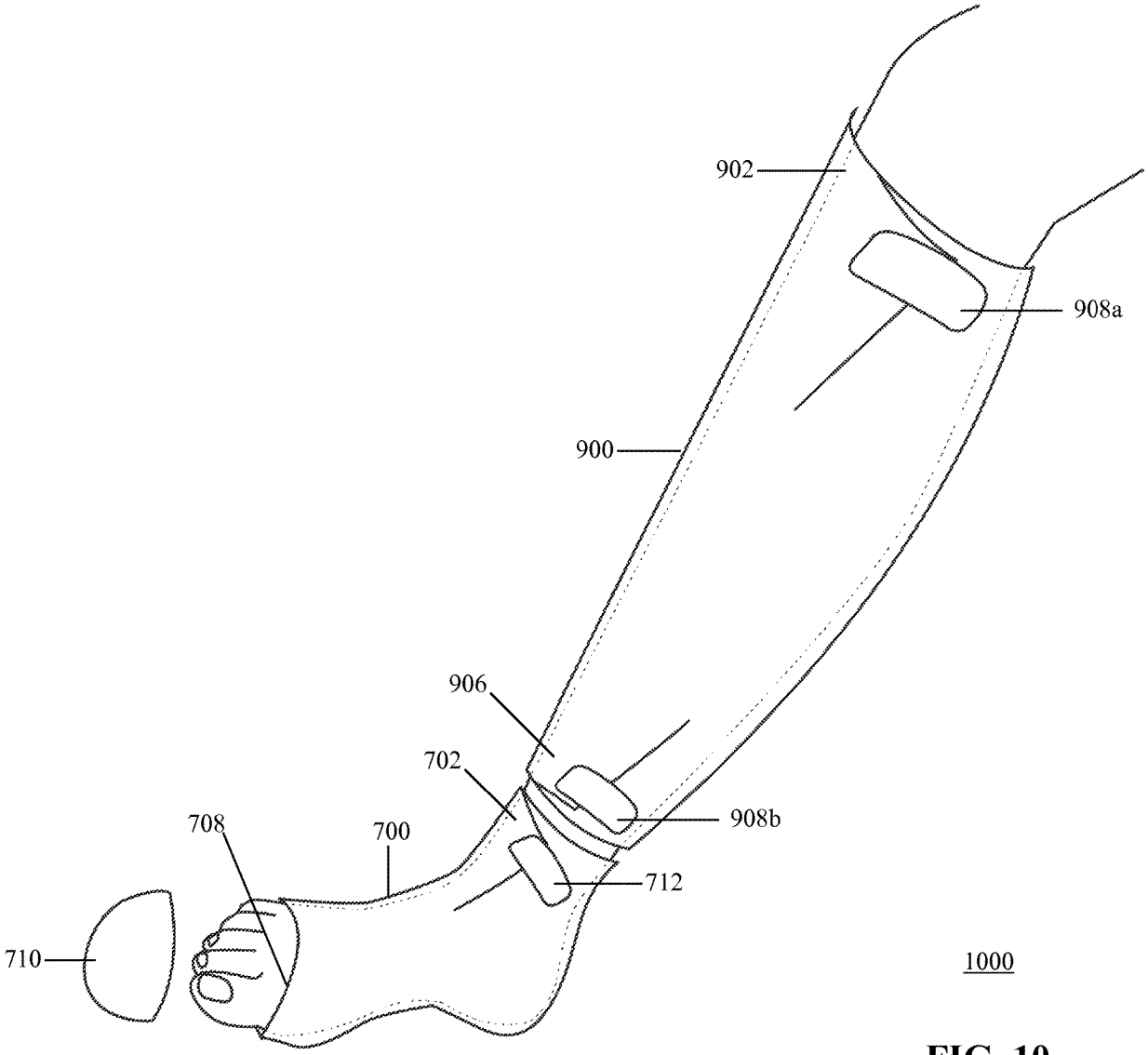
FIG. 10 is an elevated view of a skin care mask sock in use in accordance with an embodiment of the disclosed subject matter.

FIG. 10 is an elevated view of sock 1000 in use in accordance with an embodiment of the disclosed subject matter. Removable toe tip 710 is torn off along perforated line 708 and separated from sock 1000 so that the wearer can expose her toes, e.g., for receiving useful services while still wearing sock 1000. Tightening strap 712 is used to tighten opening section 702 and tightening straps 908*a-b* are used to tighten opening section 902 and wrist section 906, respectively. The user may also separate leg extension 900 from sock portion 700 along perforated line 718 (shown in FIG. 9) either before or after wearing sock 1000.

It is to be understood that the disclosed subject matter is not limited in its application to the details of construction and to the arrangements of the components set forth in the following description or illustrated in the drawings. The disclosed subject matter is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures for carrying out the several purposes of the disclosed subject matter. It is important, therefore, that the claims be regarded as including such equivalent constructions insofar as they do not depart from the spirit and scope of the disclosed subject matter.

Although the disclosed subject matter has been described and illustrated in the foregoing exemplary embodiments, it is understood that the present disclosure has been made only by way of example, and that numerous changes in the details of implementation of the disclosed subject matter may be made without departing from the spirit and scope of the disclosed subject matter, which is limited only by the claims which follow.

What is claimed is:

1. A skin care mask sock, comprising:

a sock portion having:

a first opening section having a first opening configured for receiving a foot and a first tightening strap for tightening said first opening section after the foot is inserted;

a foot section; and a toe section having a first perforated line and a first removable toe tip portion, said first perforated line configured to extend across a user's toes such that when the first removable toe tip portion is removed along the first perforated line, all of the user's toes are exposed, wherein said sock portion includes a first outer layer, a first inner layer and a layer of a first skin care product; and a leg extension portion having:

a second opening section having a second opening configured for receiving the foot and a second tightening strap for tightening said second opening section after the foot is inserted;

a leg section; and an ankle section coupled to said first opening section and having a third opening and a third tightening strap for tightening said ankle section after the foot is inserted, wherein said first opening section is coupled to said ankle section via a middle section having a second perforated line; and wherein said leg extension portion includes a second outer layer, a second inner layer and a layer of a second skin care product.

2. The skin care mask sock of claim 1, wherein said first tightening strap includes an area containing hook-type fasteners and wherein said first opening section includes an area containing loop-type fasteners for receiving said hook-type fasteners.

3. The skin care mask sock of claim 1, wherein said first tightening strap includes an area having a type of adhesive-backed tape.

4. The skin care mask sock of claim 1, wherein said first opening section further includes a first spot hot stamp line disposed in parallel with said first opening and configured to facilitate an opening-up of said first opening.

5. The skin care mask sock of claim 4, wherein said second opening section further includes a third perforated line disposed in parallel with said second opening and a second removable end-portion and wherein said ankle section further includes a second spot hot stamp line disposed in parallel with said third opening.

6. The skin care mask sock of claim 1, wherein said first skin care product and said second skin care product are not a same product.

* * * * *